United States Patent [19]

Watanabe et al.

[11] Patent Number: 4,560,430

[45] Date of Patent: Dec. 24, 1985

[54] METHOD OF MAKING A METALLIC CONTAINER

[75] Inventors: Michio Watanabe, Yokohama; Kazuhisa Ishibashi, Tokyo; Hisakazu Yasumuro, Yokohama; Hideo Kurashima; Tsuneo Imatani, both of Yokosuka, all of Japan

[73] Assignee: Toyo Seikan Kaisha, Limited, Tokyo, Japan

[21] Appl. No.: 519,223

[22] Filed: Aug. 2, 1983

[51] Int. Cl.[4] ..... B29C 17/00; B29C 19/06; B65C 3/26; C09J 5/00

[52] U.S. Cl. ..... 156/285; 156/156; 156/274.8; 156/275.3; 156/306.6; 29/DIG. 1

[58] Field of Search ..... 156/304.2, 306.6, 312, 156/324.4, 156, 275.1, 275.3, 69, 274.8, 285; 29/458, 469, DIG. 1, 463

[56] References Cited

U.S. PATENT DOCUMENTS

| | | | |
|---|---|---|---|
| 3,383,260 | 5/1968 | Mojonnier | 156/304.2 |
| 3,801,402 | 4/1974 | Suter | 156/285 |
| 4,304,038 | 12/1981 | Yabo et al. | 156/304.2 |
| 4,435,240 | 3/1984 | Knaus et al. | 156/285 |

*Primary Examiner*—Edward Kimlin

*Assistant Examiner*—Louis Falasco

*Attorney, Agent, or Firm*—Armstrong, Nikaido, Marmelstein & Kubovcik

[57] ABSTRACT

There is provided a method of making a metallic container having a predetermined or standard height and a circumferential seam of the type which is formed by fitting a first open end portion of an upper can body having a venting portion and a second open end portion of a lower can body having a bottom portion to each other with a heat sealable adhesive layer therebetween to form a metallic container preform having a fitted portion, and heating the fitted portion thereby to fuse the adhesive layer.

The container preform is placed between a first member and a second member which are oppositely disposed with a predetermined distance therebetween, such that the venting portion faces the first member and the bottom portion faces the second member, then the fitted portion is heated, simultaneously the internal pressure of the container preform is allowed to enhance, and the axial outward slip between the first and second open end portions through the fused adhesive layer which is caused by the elevated internal pressure, is suppressed by the first and second members.

13 Claims, 5 Drawing Figures

METHOD OF MAKING A METALLIC CONTAINER

BACKGROUND OF THE INVENTION

The present invention relates to a method of making a metallic container, and more particularly to a method of making a metallic container having a circumferential seam bonded with an adhesive layer.

In FIG. 1 there is illustrated a metallic container 1 of the type to which the method of the invention will be applied. The metallic container 1 is formed by telescoping the necked-in open end portion 3*b* of a relatively thin-walled lower can body 3 having a bottom portion 3*a* into the open end portion 2*b* of a relatively thin-walled upper can body 2 having a venting portion 2*a*, with an adhesive layer 4 interposed therebetween, and heating the fitted portion thus formed to the heat sealable temperature of the plastic forming the adhesive layer 4, thereby forming a circumferential seam 5.

In case where the metallic container 1 is sealed by clinching the venting portion 2*a* with a metallic cap 6 by using a clincher not shown, when the heights of the containers 1 are not uniform, the following difficulties are often encountered. The container 1 having a height smaller than the standard value tends to fail to be hermetically sealed, and the container 1 having a height larger than the standard value tends to be buckled at its sidewall portion 1*a*, resulting in a container having no commercial value, since the distance between a mounting plate not shown for the container 1 and the pawls (not shown) of the clincher is constant regardless of the variation of the height of the container 1.

In the process of making the container 1, while the container preform is transferred from a telescoping apparatus to an apparatus for heating the fitted portion, the fitted portion is liable to axial slip, or the upper can body 2 tends to tilt with respect to the lower can body 3. Accordingly, even if the container preforms as telescoped are uniform in height, it is difficult to obtain containers 1 having a uniform height by merely heating the fitted portion.

Furthermore, relatively thin-walled open end portions 2*b* and 3*b*, e.g., having the thickness of 0.15 to 0.30 mm often fail to form a round fitted portion. Therefore, in case where the fitted portion is heated by means of a heating means such as a high frequency induction heating coil, the circumferential space between the fitted portion and the heating means tends to become uneven, and thus the heating along the fitted portion tends to be not uniform. As a result there is often formed the circumferential seam 5 in which air- or liquid-tightness is poor owing to imperfect heat fusion of the adhesive layer 4 by shortage of heating, or a burnt primer coating thereon by overheating.

SUMMARY OF THE INVENTION

The general object of the invention is to provide a method of making metallic containers having a circumferential seam with an adhesive layer formed by heat fusion, and having a uniform height.

The specific object of the invention is to provide a method of making a metallic container provided with a circumferential seam having improved air- or liquid-tightness, which is free from defects such as an imperfectly heat fused adhesive layer by shortage of heating, or a burnt primer coating thereon by overheating.

According to the method there is provided a method of making a metallic container having a circumferential seam, the circumferential seam being formed by fitting a first open end portion of an upper can body having a venting portion and a second open end portion of a lower can body having a bottom portion to each other with a heat sealable adhesive layer therebetween to form a metallic container preform having a fitted portion, and heating the fitted portion thereby to fuse the adhesive layer, which comprises placing the container preform between a first member and a second member which are oppositely disposed with a predetermined distance therebetween, such that the venting portion faces the first member and the bottom portion faces the second member, heating the fitted portion, simultaneously enhancing the internal pressure of the container preform, and suppressing the axial outward slip between the first and second open end portions through the fused adhesive layer which is caused by the elevated internal pressure, by the first and second members, thereby to form the container having a predetermined height.

According to one aspect of the invention, the first member is a sealing member having an annular groove into which the end portion of the venting portion can be snugly inserted, and the bottom surface of which is adapted to be brought into close contact with the end portion with the elevated internal pressure, the second member is a mounting means for the bottom portion of said preform, and the fitted portion is heated with the venting portion hermetically sealed, thereby to enhance the internal pressure of the container preform due to thermal expansion of the air inside the preform.

According to another aspect of the invention, the first member is a height setting means which is disposed such that the bottom surface thereof is brought into contact with an upper surface of a sealing member sealing the venting portion with the elevated internal pressure, the second member is a mounting means for the bottom portion of the preform, and the fitted portion is heated with the venting portion hermetically sealed, thereby to enhance the internal pressure of the container preform due to thermal expansion of the air inside the preform.

According to still another aspect of the invention, the first member is a sealing member having an annular groove into which the end portion of the venting portion can be snugly inserted, and the bottom surface of which is adapted to be brought into close contact with the end portion with the elevated internal pressure, and having a fluid passage for supplying a pressurized gas into the preform, the second member is a mounting means for the bottom portion of the preform, and the pressurized gas is supplied into the preform through the venting portion hermetically sealed, thereby to enhance the internal pressure of the preform.

Other objects and advantages of the invention will be apparent from the following description, which, taken in connection with the accompanying drawings wherein like parts are designated by the same numerals throughout the various figures, discloses preferred embodiments thereof.

DESCRIPTION OF THE PREFERRED EMBODIMENT

Figure 1:
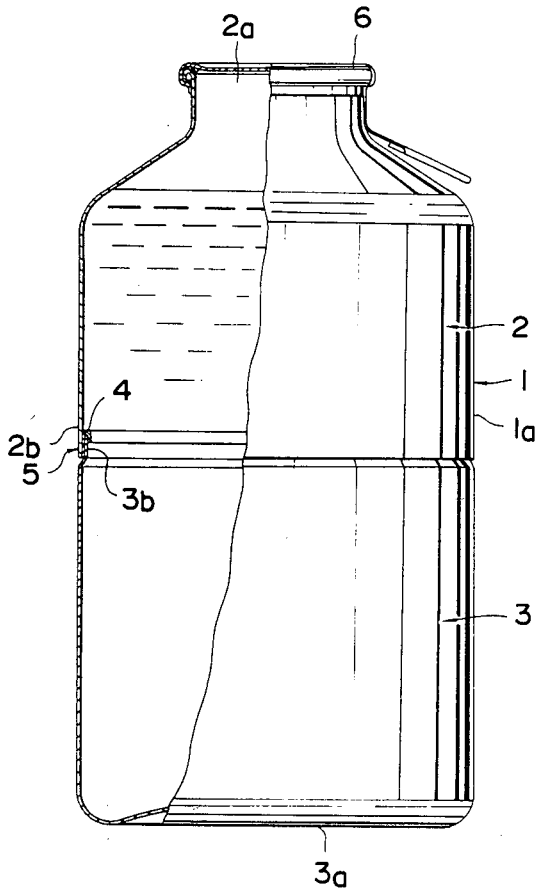
FIG. 1 is a fragmentary sectional front view of an example of a metallic container to be applied to the invention which is sealed with a cap.
Figure 2:
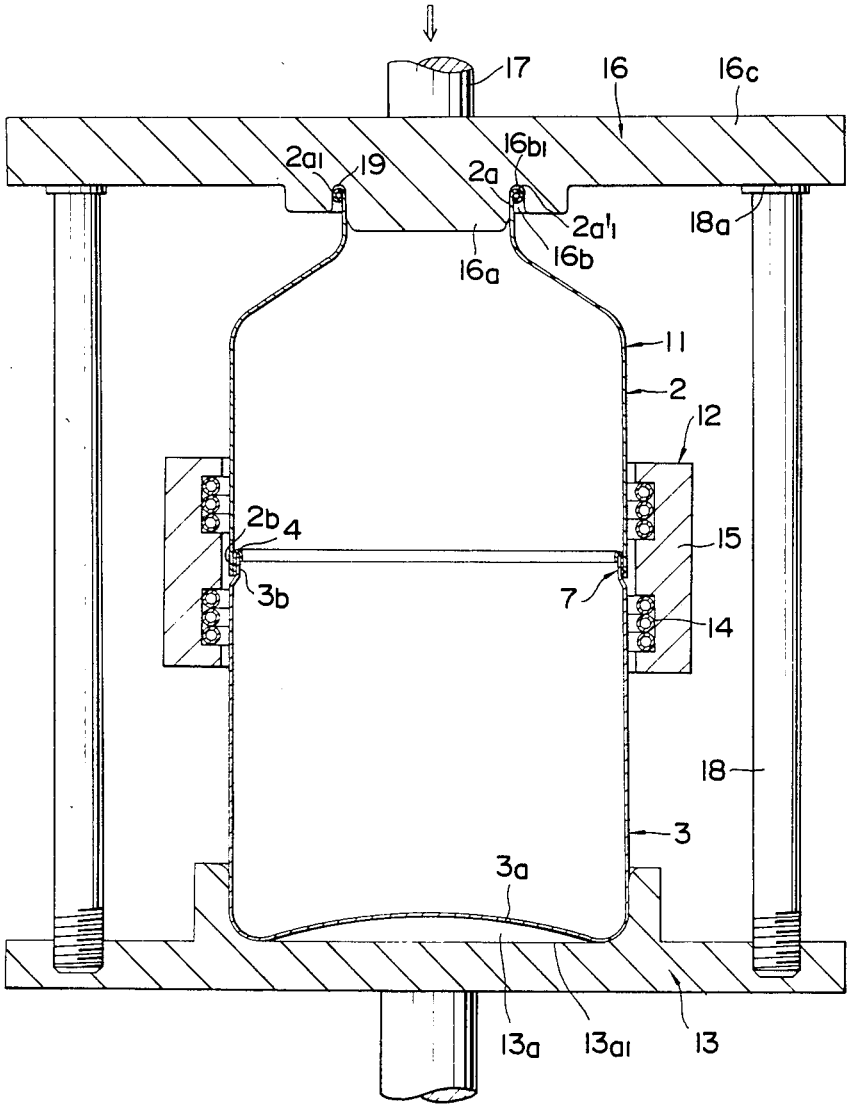
FIGS. 2 and 3 are vertical sectional views for explaining the first embodiment of the invention, FIG. 2 showing the state preparatory to heating the fitted portion, and FIG. 3 showing the state after heating the fitted portion.
Figure 3:
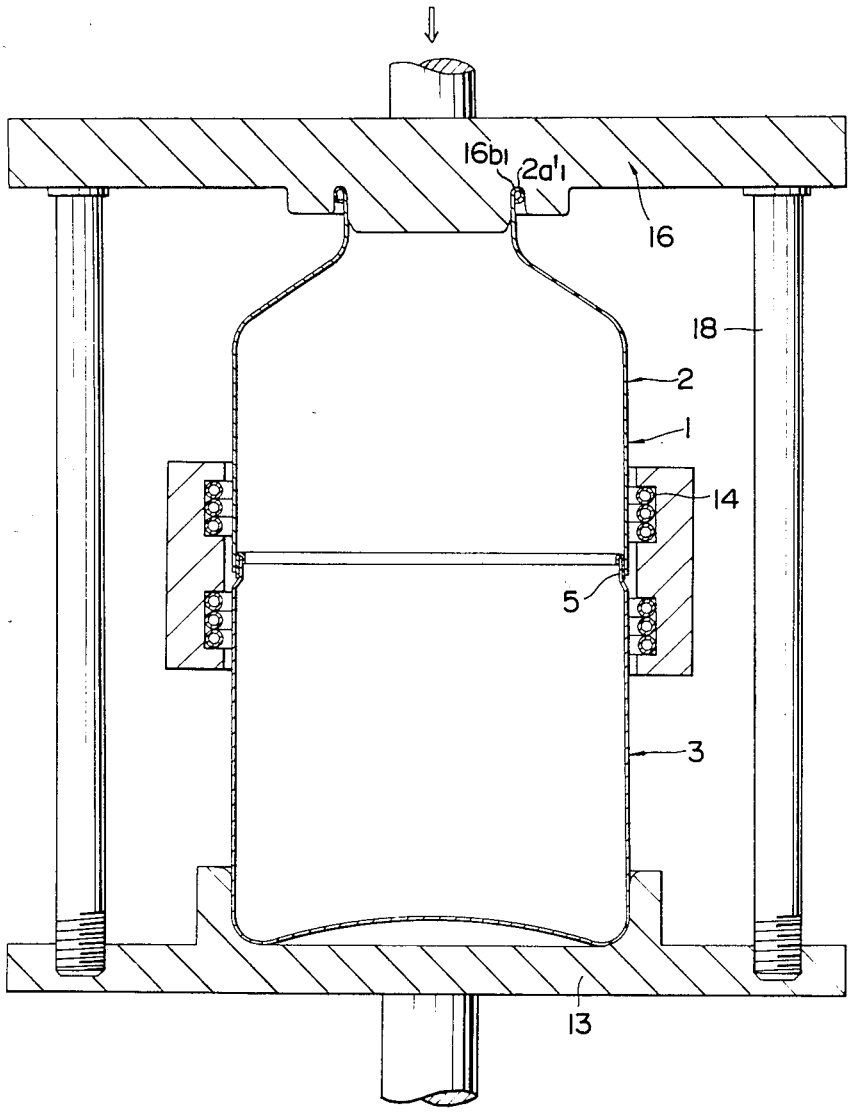

Referring to FIGS. 2 and 3 showing the first embodiment of the invention, a metallic container preform 11 has an upper can body 2 and a lower can body 3, wherein the necked-in open end portion 3b of the lower can body 3 is telescoped or fitted into the open end portion 2b of the upper can body 2 with an adhesive layer 4 therebetween to form a tightly fitted portion 7.

The upper can body 2 is formed by, e.g., drawing a relatively thin metallic blank having a thickness of about 0.15 to 0.30 mm which may be made of tinplate or aluminum alloy sheet lacquered at least on the surface to be the inside surface of the container, thereby to form a cup-shaped article, plunging the bottom portion thereof to form a venting portion 2a having a head portion $2a_1$ along the end portion thereof for engaging a metallic cap 6.

The lower can body 3 is formed by, e.g., drawing a metallic blank of the same type as one used for the upper can body 2 to form a cup-shaped article having the same outside diameter as that of the upper can body 2, necking-in the open end thereof to form a necked-in open end portion 3b, and then forming an adhesive layer 4 of a heat sealable thermoplastic along at least the outer circumferential surface of the necked-in open end portion 3b. In case of FIG. 2, the adhesive layer 4 covers the raw edge and the inner circumferential surface of the necked-in portion 3b so as to protect the raw edge from corrosion.

Thermoplastics having a relatively low melting point and a polar group such as modified linear polyesters, nylon 11 or 12, or acid-modified polyolefins are preferably employed for the adhesive layer 4. The adhesive layer 4 may be formed by powder coating or coating of slurry lacquers or the like. However, applying of a thermoplastic tape by fusion adhering to the necked-in portion 3b is most desirable to form an adhesive layer of uniform thickness and free from defects such as pinholes.

The fitted portion 7 is formed by telescoping under hoop stress by means of a proper telescoping or fitting means, e.g., a die means for telescoping of the type such as disclosed in U.S. Pat. No. 4,258,855.

The preform 11 thus assembled is transferred to a heating apparatus 12 for heating the fitted portion 7 to form a circumferential seam 1 having the adhesive layer 4 fusion adhered to the inner surface of the open end portion 2b of the upper can body 2.

The heating apparatus 12 is provided with a mounting plate 13 for the container preform 11, a high frequency induction heating coil 14, and a magnetic core 15 made of ferrite surrounding the heating coil 14. The mounting plate 13 is formed with a mounting portion 13a for the preform 11 having a cavity of an inside diameter substantially same as the outside diameter of the lower can body 3. The heating coil 14 and the magnetic core 15 supported by a supporting member not shown are disposed around the preform 11 such that magnetic fluxes concentrate most highly along the fitted portion 7 of the preform 11 inserted into the mounting portion 13a.

A sealing member 16 is provided with a plug portion 16a which is adapted to be snugly inserted into the venting portion 2a of the upper can body 2, and an annular groove 16b surrounding the plug portion 16a and having a bottom surface $16b_1$ of the configuration corresponding to the upper surface $2a_1'$ of the bead portion $2a_1$, into which the bead portion $2a_1$ can be snugly inserted. At least the circumferential side surface of the annular groove 16b are preferably made of a low frictional material such as polyfluorocarbon or MC nylon, such that the bead portion $2a_1$ can slide smoothly along the circumferential side surfaces.

The horizontally extending sealing member 16 is adapted to be moved up and down through a driving shaft 17 by means of a driving means not shown, such that the annular groove 16b is in alignment with the mounting portion 13a.

A plurality of engaging shafts 18 are fixed to the mounting plate 13 such that the peripheral portion 16c of the sealing member 16 may be engaged with the upper surface 18a of the engaging shaft 18. The height of the engaging shaft 18 is dimensioned such that at the aforementioned engaging state the distance between the bottom surface $13a_1$ of the mounting portion 13a and the bottom surface 16b of the annular groove 16b is equal to the standard or predetermined height of the metallic container 1 to be made. The height of the preform 11 at the state that it has been placed on the mounting portion 13a is usually slightly (e.g. less than about 1 mm) smaller than the aforementioned standard height, so that there is a gap 19 between the upper surface $2a_1'$ of the bead portion $2a_1$ and the bottom surface $16b_1$ of the annular groove 16b, as shown in FIG. 2.

Using the heating apparatus 12 and the sealing member 16, the container 1 is made from the preform 11 in the following manner. After the preform 11 has been placed on the mounting portion 13a, and surrounded by the heating coil 14, the sealing member 16 is allowed to lower and engage with the engaging shaft 18 under pressure. Simultaneously the plug portion 16a and the bead portion $2a_1$ are inserted into the venting portion 2a and the annular groove 16b, respectively. As the result, in case where the upper can body 2 is tilted with respect to the lower can body 3, the inclination is adjusted so that they are in alignment with each other, as shown in FIG. 2.

Thereafter the heating coil 14 is energized to heat the fitted portion 7, and the adhesive layer 4 is heated to the heat sealable temperature, that is, a temperature higher than the melting point or the softening point of the plastic concerned; generally a temperature higher than about 200° C., thereby melting or softening, that is, fusing.

Simultaneously the air inside the preform 11 rises in temperature, and the air at elevated temperatures tries to escape through the gap between the venting portion 2a and the plug portion 16a owing to thermal expansion. The gap, however, is so small that the escaping amount of the air is limited, and thus the internal pressure of the preform 11 is usually enhanced to about $0.07 \sim 0.15$ kg/cm$^2$ (gage pressure). As the result the upper can body 2 rises until the upper surface $2a_1'$ of the bead portion $2a_1$ is brought into close contact with the bottom surface $16b_1$ of the annular groove 16b, while the open end portion 2b and the venting portion 2a of the upper can body 2 slide along the molten adhesive layer 4 and the side surface of the plug portion 16a, respectively (refer to FIG. 3), whereby the axial outward slip between the open end portions 2b and 3b is suppressed. Since the upper surface $2a_1$ has a shape corresponding to that of the bottom surface $16b_1$, and is in close contact with the latter under the internal air pressure and a downward force exerted to the sealing member 16, the preform 11 becomes substantially airtight.

Usually the heating coil 14 is energized for about 0.3 to 2.0 seconds. Subsequently the heating coil 14 is deenergized, and thus the heat at the fitted portion 7 and its vicinity rapidly moves to the other portions of the upper and lower can bodies 2, 3 due to heat conduction. As the result the adhesive layer 4 is cooled and solidified, thereby to form the circumferential seam 5. Since the cooling rate of the inside air is lower than that of the adhesive layer 4, the internal air pressure is hardly reduced, and the upper surface $2a_1'$ is kept in close contact with the bottom surface $16b_1$, until the adhesive layer 4 is solidified, thereby forming the metallic container 1 having the standard height and the circumferential seam 5 such as shown in FIG. 3.

Thereafter the sealing member 16 is raised to remove the container 1 from the mounting plate 13, and then the container 1 is delivered for the next process.

Figure 4:
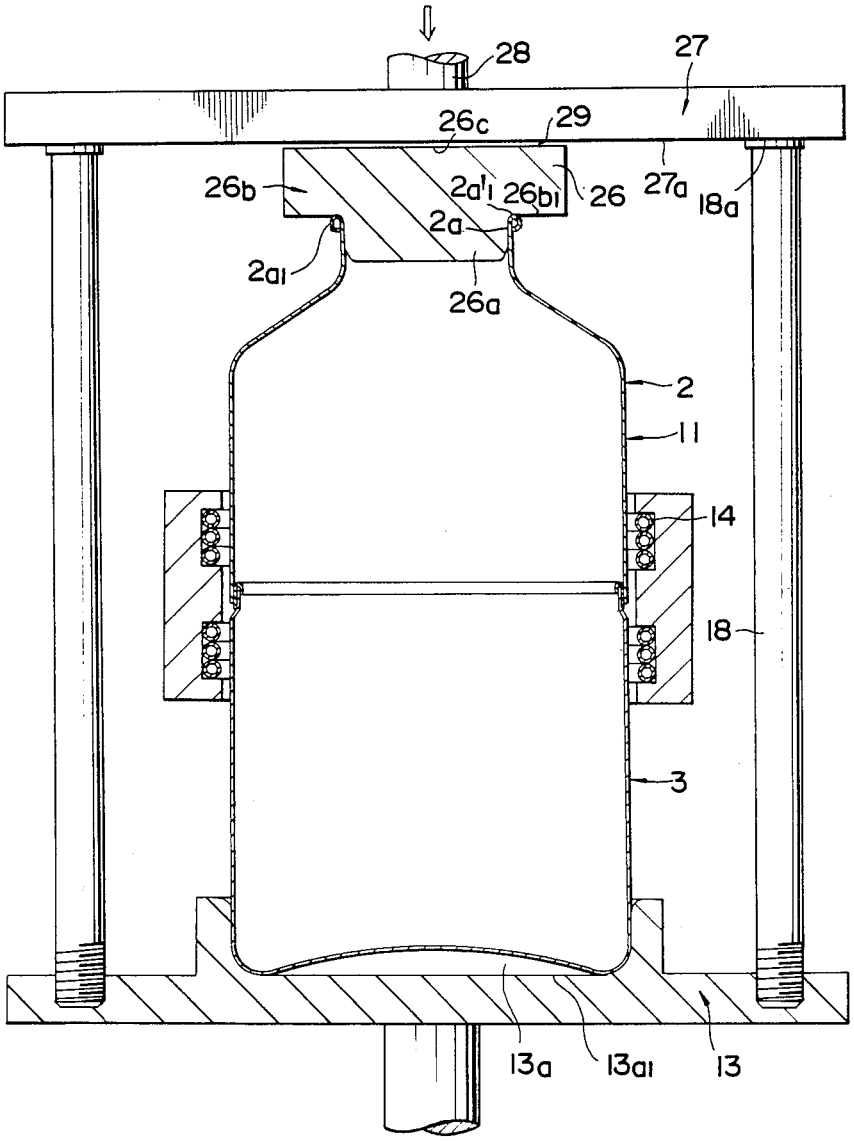
FIG. 4 is a vertical sectional view for explaining the second embodiment of the invention, which shows the state preparatory to heating the fitted portion.

FIG. 4 illustrates a second embodiment for making the container 11 by using a height setting means independent on the sealing member.

Referring to FIG. 4 a sealing member 26 which is made of plastic such as MC nylon is provided with a plug portion 26a which is adapted to be tightly telescoped into the venting portion 2a to seal hermetically the latter, and a flange portion 26b the inner end of whose bottom surface $26b_1$ is adapted to be brought into contact with the upper surface $2a_1'$ of the bead portion $2a_1$. The upper surface 26c of the sealing member extends horizontally and in parallel with the bottom surface $26b_1$ of the flange portion 26b.

A height setting plate 27 having a horizontally extending bottom surface 27a is adapted to be moved up and down through a driving shaft 28 by means of a driving means not shown, and engaged with the upper surface 18a of the engaging shaft 18 under pressure. The axial spacing between the bottom surface $13a_1$ of the mounting plate 13a and the upper surface 18a of the engaging shaft 18 is dimensioned to be equal to the standard height of the metallic container 1. At the state that the preform 11 having the sealing member 26 telescoped thereinto is placed on the mounting portion 13a, there is a horizontally extending gap 29 which is usually less than 1 mm, between the upper surface 26c and the bottom surface 27a, as shown in FIG. 4.

When the heating coil 14 is energized, in a similar manner as the first embodiment, the upper can body 2 rises together with the sealing member 26 due to the internal air pressure, and the upper surface 26c of the sealing member 26 is brought into contact with the bottom surface 27a of the height setting plate 27, so that the inclination of the upper can body 2, if any, is corrected and the container 1 of the standard height is obtained.

Figure 5:
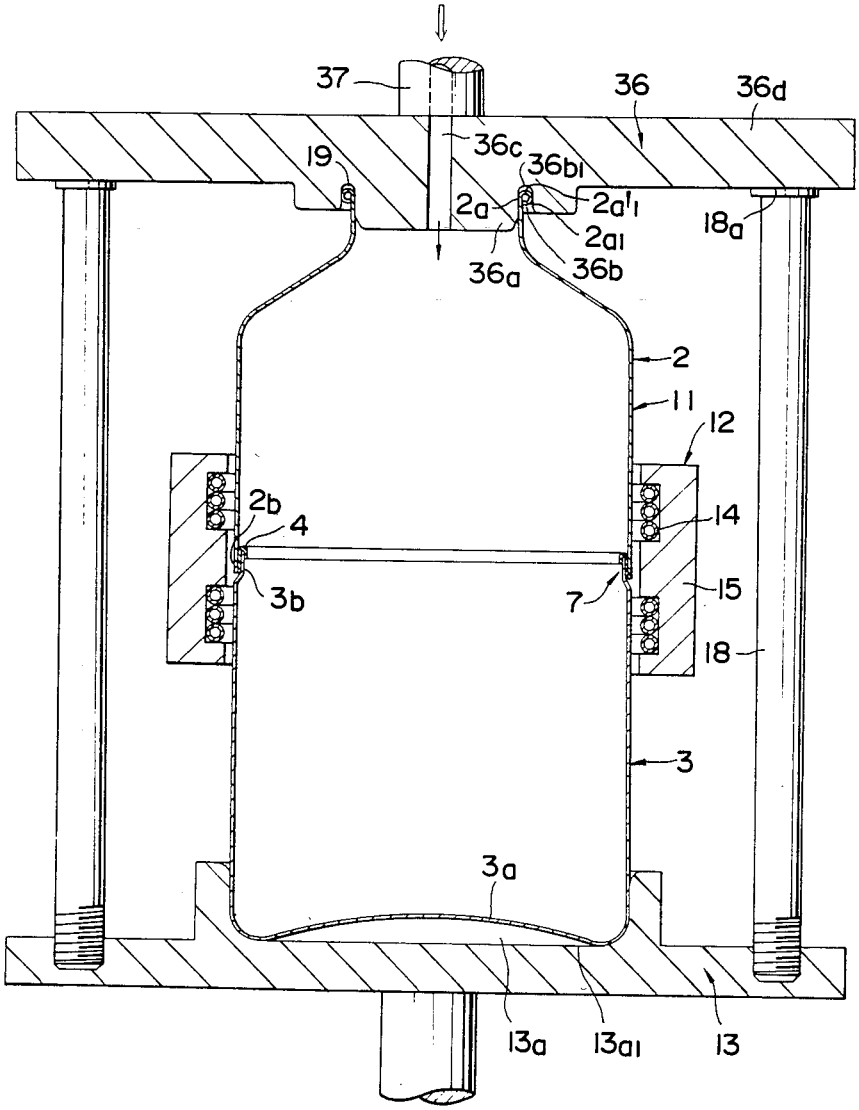
FIG. 5 is a vertical sectional view for explaining the third embodiment of the invention, which shows the state preparatory to heating the fitted portion.

FIG. 5 indicates a third embodiment wherein pressurized gas such as pressurized air is introduced into the preform 11 through the venting portion 2a, thereby to form a container having the standard height as well as a circumferential seam 5 which is free from defects and airtight, by allowing the fitted portion 7 to be round during heat sealing.

Referring to FIG. 5, a sealing member 36 is provided with a plug portion 36a which is adapted to be snugly inserted into the venting portion 2a, and an annular groove 36b surrounding the plug portion 36a and having a bottom surface $36b_1$ of the configuration corresponding to the upper surface $2a_1'$ of the bead portion $2a_1$, into which the head portion $2a_1$ can be snugly inserted.

A fluid passage 36c for supplying pressurized gas passes through the plug portion 36a and a driving shaft 37, and communicates to a pressurized gas source not shown.

The driving shaft 37, the engaging shaft 18 and the heating apparatus 12 are constructed in the same manner as those in the first embodiment.

In this embodiment the container 1 is made from the preform 11 in the following manner. After the preform 11 has been placed on the mounting portion 13a, the sealing member 36 is allowed to lower and engage with the engaging shaft 18 under pressure. Simultaneously the plug portion 36a and the bead portion $2a_1$ are inserted into the venting portion 2a and the annular groove 36b, respectively, with a gap 19 between the upper surface $2a_1'$ and the bottom surface $36b_1$.

As the result the inclination of the upper can body 2, if any, is corrected such that the upper can body 2 is in alignment with the lower can body 3.

Thereafter the heating coil 14 is energized, and simultaneously pressurized gas such as pressurized air is supplied into the preform 11 through the fluid passage 36c. As the result the adhesive layer 4 is molten or softened, and the internal pressure of the preform 11 is enhanced, so that the upper can body 2 rises until the upper surface $2a_1'$ of the bead portion $2a_1$ is brought into close contact with the bottom surface $36b_1$ of the annular groove 36b, and the preform 11 becomes substantially airtight in the same manner as the case of the first embodiment.

Owing to the internal gas pressure a radially outwardly directed force is exerted to the fitted portion 7 and the fitted portion 7 becomes round, so that the fitted portion 7 is heated substantially uniformly along all the circumference thereof by means of the heating coil 14.

It is desirable to control the pressure and amount of the supplied gas such that the internal pressure is higher than about 0.3 $kg/cm^2$ (gage pressure) so as to assure the perfect roundness of the fitted portion 7. Even if the internal pressure is pretty high, the pressurized gas will not leak through the molten adhesive layer 4. However, in this case the sealing member 36, the mounting plate 13 and the supporting frame thereof must be sturdy enough to withstand the force exerted thereto.

Usually an internal pressure of about 0.3 to 1.0 $kg/cm^2$ gives a satisfactory result. As aforementioned, the internal pressure of about 0.1 $kg/cm^2$ is enough to adjust only the height of the container 1.

Usually the heating coil 14 is energized for about 0.3 to 2.0 seconds. Subsequently the heating coil 14 is deenergized while maintaining the internal pressure of preform 11, and thus the heat at the fitted portion 7 and its vicinity rapidly moves to the other portions of the upper and lower can bodies 2, 3 due to heat conduction.

As the result the adhesive layer 4 is cooled and solidified, thereby to form the circumferential seam 5. Since the upper surface $2a_1'$ is in close contact with the bottom surface $36b_1$ during the above step, there can be obtained the metallic container 1 having the circumferential seam 5 and the standard height. Thereafter the pressurized gas in the container 1 is discharged, and the sealing member 36 is raised to remove the container 1 from the mounting plate 13.

While certain embodiments of the invention have been described for purposes of illustration, it is to be understood that there may be various embodiments and modifications within the general scope of the invention. For example, the fitted portion 7 may be heated while the preform 11 is rotated about its axis, using an arc-shaped high frequency induction heating coil which is disposed to face part of the fitted portion 7 without facing all the circumferential length thereof. The fitted portion 7 may be heated by direct firing or with infrared rays. Further, the upper and lower can bodies may be of various configurations and have a sideseam extending axially such as a welded portion. The open end of the upper can body may be necked-in, without necking-in the open end of the lower can body.

What is claimed is:

1. A method of making a metallic container having a circuferential seam, said circumferential seam being formed by fitting a first open end portion of an upper can body having a venting portion and a second open end portion of a lower can body having a bottom portion to each other with a heat sealable layer therebetween to form a metallic container preform having a fitted portion, said first and second end portions extending axially and straightly, and heating the fitted portion thereby to fuse said adhesive layer, which comprises placing said container preform between a first member and a second member which are oppositely disposed with a predetermined distance therebetween, such that said venting portion faces said first member and said bottom portion faces said second member, heating said fitted portion, while simultaneously enhancing through a gaseous medium an internal pressure generated in said container prefrom, thus causing an axial outward slip between said first and second open end portions through said fused adhesive layer by the elevated internal pressure, until said container preform has a predetermined height, and then suppressing any further axial outward slip by said first and second members when said container preform has reached said predetermined height, thereby to form said container having said predetermined height.

2. A method claimed in claim 1 wherein said fitted portion is heated with said venting portion hermetically sealed, thereby to enhance the internal pressure of said container preform due to thermal expansion of the air inside said preform.

3. A method claimed in claim 1 wherein pressurized gas is supplied into said preform through said venting portion hermetically sealed, thereby to enhance the internal pressure of said preform.

4. A method claimed in claim 1 wherein said upper can body is formed by drawing a metallic blank having a thickness of 0.15 to 0.30 mm into a cup-shaped article.

5. A method claimed in claim 1 wherein said lower can body is formed by drawing a metallic blank having a thickness of 0.15 to 0.30 mm into a cup-shaped article.

6. A method claimed in claim 1 wherein either of said upper can body and said lower can body has a necked-in open end portion.

7. A method claimed in claim 1 wherein said fitted portion is heated by means of a high frequency induction heating coil.

8. A method claimed in claim 2 wherein said first member is a sealing member having an annular groove into which the end portion of said venting portion can be snugly inserted, and the bottom surface of which is adapted to be brought into close contact with said end portion with said elevated internal pressure, and said second member is a mounting means for the bottom portion of said preform.

9. A method claimed in claim 2 wherein said first member is a height setting means which is disposed such that the bottom surface thereof is brought into contact with an upper surface of a sealing member sealing said venting portion with said elevated internal pressure, and said second member is a mounting means for the bottom portion of said preform.

10. A method claimed in claim 2 wherein said elevated internal pressure is 0.07 to 0.15 $kg/cm^2$.

11. A method claimed in claim 3 wherein said first member is a sealing member having an annular groove into which the end portion of said venting portion can be snugly inserted, and the bottom surface of which is adapted to be brought into close contact with said end portion with said elevated internal pressure, and having a fluid passage for supplying a pressurized gas into said preform, and said second member is a mounting means for the bottom portion of said preform.

12. A method claimed in claim 3 wherein said elevated internal pressure is 0.3 to 1.0 $kg/cm^2$.

13. A method claimed in claim 6 wherein said adhesive layer is made of a thermoplastic and formed along said necked-in open end portion preparatory to said fitting.

* * * * *